US011918034B2

(12) United States Patent
Jin et al.

(10) Patent No.: US 11,918,034 B2
(45) Date of Patent: Mar. 5, 2024

(54) DEVICE AND METHOD FOR PREPARING FULLY GRANULAR CIGARETTE/FILTER ROD, AND PREPARED FULLY GRANULAR CIGARETTE/FILTER ROD

(71) Applicant: CHINA TOBACCO HUNAN INDUSTRIAL CO., LTD., Hunan (CN)

(72) Inventors: Yong Jin, Hunan (CN); Qian Chen, Hunan (CN); Ke Li, Hunan (CN); Hongmei Fan, Hunan (CN); Saibo Yu, Hunan (CN); Shitai Wang, Hunan (CN); Chao Tan, Hunan (CN); Haifeng Tan, Hunan (CN); Qi Liu, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 101 days.

(21) Appl. No.: 17/625,085

(22) PCT Filed: Dec. 23, 2019

(86) PCT No.: PCT/CN2019/127356
§ 371 (c)(1),
(2) Date: Jan. 5, 2022

(87) PCT Pub. No.: WO2021/127828
PCT Pub. Date: Jul. 1, 2021

(65) Prior Publication Data

US 2022/0279840 A1 Sep. 8, 2022

(51) Int. Cl.

| | |
|---|---|
| ***A24D 3/02*** | (2006.01) |
| ***A24B 3/18*** | (2006.01) |
| ***A24B 13/02*** | (2006.01) |

(52) U.S. Cl.
CPC ..... *A24D 3/0229* (2013.01); *A24B 3/18* (2013.01); *A24B 13/02* (2013.01); *A24D 3/0287* (2013.01)

(58) Field of Classification Search
CPC .... A24D 3/0287; A24D 3/0229; A24B 13/02; A24B 3/18
See application file for complete search history.

(56) References Cited

U.S. PATENT DOCUMENTS 3,699,976 A * 10/1972 Abe ..... A24B 15/22 131/299
4,934,385 A * 6/1990 Wochnowski ..... A24B 3/00 131/299

(Continued)

FOREIGN PATENT DOCUMENTS

CN 102551208 A 7/2012
CN 103859583 A 6/2014

(Continued)

OTHER PUBLICATIONS

Machine translation of Chen to CN 107536096 A (Year: 2018).*
International Search Report issued in International Application No. PCT/CN2019/127356 dated Sep. 25, 2020, 2 pages.

*Primary Examiner* — Anna K Kinsaul
*Assistant Examiner* — Himchan Song
(74) *Attorney, Agent, or Firm* — MASCHOFF BRENNAN; Ran Pang; Michael Mauriel

(57) ABSTRACT

A device and method for preparing a fully granular cigarette/filter rod, and a prepared fully granular cigarette/filter rod are disclosed. In certain embodiments, negative pressure is used to adhere granular material onto a mesh-type conveyor belt. The granular material is preliminarily formed into fully granular cigarette/filter rod material by means of a pre-forming apparatus; the fully granular cigarette/filter rod material, traveling with the mesh-type conveyor belt, enters (Continued)

into a forming cavity, and undergoes heating and humidifying treatment, and a continuous solid porous substance is formed; the continuous solid porous substance is moved into the cooling/drying cavity, drying and cooling treatment are performed under the action of negative pressure, and a fully granular cigarette/filter rod with strong adhesion, porosity, permeability, and appropriate moisture is obtained.

7 Claims, 3 Drawing Sheets

(56) References Cited

U.S. PATENT DOCUMENTS

| | | | | |
|---|---|---|---|---|
| 7,918,232 | B2 | 4/2011 | Karles et al. | |
| 11,134,713 | B2 | 10/2021 | Williams | |
| 2011/0284015 | A1* | 11/2011 | Franke | A24B 3/08 131/81.1 |
| 2022/0279840 | A1* | 9/2022 | Jin | A24D 3/0241 |

FOREIGN PATENT DOCUMENTS

| | | | | |
|---|---|---|---|---|
| CN | 103892440 | A | | 7/2014 |
| CN | 107536096 | A | * | 1/2018 |
| CN | 107536096 | A | | 1/2018 |

* cited by examiner

DEVICE AND METHOD FOR PREPARING FULLY GRANULAR CIGARETTE/FILTER ROD, AND PREPARED FULLY GRANULAR CIGARETTE/FILTER ROD

CROSS REFERENCE TO RELATED APPLICATIONS

This application is a U.S. National Phase application under 35 U.S.C. § 371 of International Application No. PCT/CN2019/127356 filed on Dec. 23, 2019. The entire contents of this application is hereby incorporated herein by reference.

FIELD OF THE INVENTION

The present invention relates to a device for producing a cigarette/cigarette filter rod, in particular to a device and method for preparing fully granular cigarette/filter rod, and prepared fully granular cigarette/filter rod.

BACKGROUND OF THE INVENTION

Traditional cigarettes are all prepared from shredded tobacco, and fully granular cigarettes/filter rods are prepared from reconstituted tobacco granules. Compared with shredded tobacco cigarettes, the fully granular cigarettes have their own unique features. However, the existing cigarette making machines or forming machines are unable to prepare fully granular cigarette/filter rod. Cigarette filter rod is an important auxiliary material in cigarette production. In recent years, filter rod granule additives have been one of the research hotspots. Generally, granule additives are uniformly added to cellulose acetate tows to prepare granular composite filter rod, or intensively and loosely packed to prepare ternary composite filter rod, which greatly increases production and use costs of the filter rod. Some researchers proposed to prepare fully granular rod from filter rod granule additives, but how to implement continuous production of the fully granular rod has not been well solved.

How to prepare fully granular tobacco rod or granular filter rod by continuous forming of reconstituted tobacco granules or filter rod granule additives for the production of cigarette/cigarette filter rod has become an important topic in front of companies manufacturing cigarette/cigarette filter rod production device.

SUMMARY OF THE INVENTION

In order to continuously prepare fully granular cigarette/cigarette filter rod in batches, the present invention proposes a device and method for preparing fully granular cigarette/filter rod, and prepared fully granular cigarette/filter rod.

In order to solve the above technical problems, the present invention provides a device for preparing fully granular cigarette/filter rod, including a mesh conveyor belt mounted on a bracket, wherein a feeding apparatus, a pre-forming apparatus with a pre-forming cavity, a curing apparatus with a forming cavity, and a cooling/drying assembly with a cooling/drying cavity are sequentially disposed on the bracket in a conveying direction of the mesh conveyor belt;

The mesh conveyor belt includes an upper conveyor belt and a lower conveyor belt connected into a whole, and the upper conveyor belt passes a feeding port of the feeding apparatus and passes through the pre-forming cavity of the pre-forming apparatus, the forming cavity of the curing apparatus, and the cooling/drying cavity of the cooling/drying assembly;

A side wall of the pre-forming cavity is provided with a plurality of first through holes for providing negative pressure to adsorb a granular material;

A side wall of the forming cavity of the curing apparatus is provided with a plurality of second through holes for providing water-containing hot air and/or saturated water vapor to heat and humidify the material;

A side wall of the cooling/drying cavity of the cooling/drying assembly is provided with a plurality of third through holes for providing negative pressure to further discharge excess moisture under the negative pressure;

Central positions of the pre-forming cavity, the forming cavity, and the cooling/drying cavity are kept on the same horizontal straight line;

The pre-forming cavity, the forming cavity, and the cooling/drying cavity have the same cross-sectional shape, the cross-sectional area of a discharge port of the pre-forming cavity is slightly larger than that of the forming cavity, and the cross-sectional area of the forming cavity is slightly larger than that of the cooling/drying cavity.

When the present invention is used, the granular material is fed onto the mesh conveyor belt through the feeding apparatus, adsorbed on the conveyor belt under negative pressure and preliminarily formed through the pre-forming apparatus and then enters the forming cavity of the curing apparatus, the granular material is further heated and humidified in the forming cavity and tightly stacked, adhered and formed, then the obtained material enters the cooling/drying cavity of the cooling/drying assembly and further shrinks again under the negative pressure, and excess moisture is quickly discharged, followed by cooling, thus obtaining fully granular cigarette/filter rod not wrapped in paper.

Preferably, the pre-forming apparatus includes a first pressing plate and a first bottom plate buckled with each other, the pre-forming cavity is formed at the position where the first pressing plate and the first bottom plate are buckled with each other, and the cross-sectional area of the pre-forming cavity gradually reduces along a traveling direction of the material to facilitate preliminary extrusion forming on the granular material.

Preferably, opposite surfaces of the first bottom plate and the first pressing plate are respectively provided with a U-shaped groove which gradually shrinks in size along the traveling direction of the material, the U-shaped grooves of the first pressing plate and the first bottom plate correspond exactly to form the pre-forming cavity, and the first bottom plate is longer than the first pressing plate and extends to a position below the feeding port. As such, when the granular material falls onto the mesh conveyor belt through the feeding port, the granular material is adsorbed on the mesh conveyor belt under the negative pressure provided by the first through holes, and is roughly formed through the U-shaped groove which gradually shrinks in size.

Preferably, a cutting and sorting apparatus is disposed at an output end of the cooling/drying assembly to facilitate cutting and sorting of the formed fully granular cigarette/filter rod not wrapped in paper.

Preferably, a paper wrapping apparatus and a cutting and sorting apparatus are sequentially disposed at the output end of the cooling/drying assembly, and central positions of the cooling/drying cavity and the paper wrapping apparatus are kept on a horizontal straight line to facilitate paper wrapping, cutting and sorting of the formed fully granular cigarette/filter rod.

The paper wrapping apparatus and the cutting and sorting apparatus may be a general paper wrapping unit and a general cutting unit of the existing cigarette making machine and/or filter rod forming machine, and the general paper wrapping unit and the general cutting unit may also be reformed according to actual requirements.

Preferably, the cross-sectional shape of the forming cavity is determined by the cross-sectional shape of fully granular cigarette/filter rod, and may be any of a circle, an ellipse, a diamond, a square, etc.; or the aforementioned shape may also have any hollow pattern.

Preferably, the pre-forming apparatus is composed of a front bottom plate of a forming garniture and a front pressing plate of the forming garniture; opposite surfaces of the front bottom plate and the front pressing plate corresponding with each other are provided with U-shaped grooves that are combined into a pre-forming cavity whose size gradually changes; a wall of the U-shaped groove of the front bottom plate is provided with a plurality of negative pressure adsorption holes connected to a negative pressure apparatus, and the front bottom plate is longer than the front pressing plate. A fabric belt is guided by a guide wheel into the U-shaped groove, with negative pressure adsorption holes, of the front bottom plate of the forming garniture. Under the action of negative pressure, the granules and the fabric belt are tightly adsorbed on the wall of the U-shaped groove and gradually shrink in size with the groove. The fabric belt wrapping the granular material gradually shrinks in size and enters the pre-forming cavity, and the granular material is pre-formed into the required shape and then enters the curing apparatus.

Preferably, the curing apparatus includes a second pressing plate and a second bottom plate joined together, opposite surfaces of the second pressing plate and the second bottom plate are respectively provided with a groove, and the grooves of the second pressing plate and the second bottom plate correspond exactly to form the forming cavity together;

The cooling/drying assembly includes a third pressing plate and a third bottom plate joined together, opposite surfaces of the third pressing plate and the third bottom plate are respectively provided with a groove, and the grooves of the third pressing plate and the third bottom plate correspond exactly to form the cooling/drying cavity together.

Preferably, both the second pressing plate and the second bottom plate are provided with a first air cavity connected to external water vapor/humid hot air, and are provided with the second through holes; and the first air cavity is communicated with the forming cavity via the second through holes uniformly distributed. The second through holes have a diameter of 0.3 to 0.8 mm and a distance between adjacent second through holes is 5 to 10 mm. The second through holes are used to provide water-containing hot air and/or saturated water vapor, so that granules have wet surfaces and are preliminarily adhered and formed.

Preferably, power adjustable microwave generating apparatuses are disposed in the second pressing plate and the second bottom plate, for quickly heating or curing granules with microwave.

Preferably, electric heating tubes are disposed in the second pressing plate and the second bottom plate, for directly heating granules or assisting in heating the water-containing hot air and/or saturated water vapor, Preferably, the cross-sectional area of the cooling/drying cavity is 85-95% of that of the forming cavity.

Preferably, both the third pressing plate and the third bottom plate are provided with a second air cavity connected to the negative pressure apparatus, and the second air cavity is communicated with the cooling/drying cavity via the third through holes uniformly distributed. The third through holes have a diameter of 0.5 to 2 mm and a distance between adjacent third through holes is 2 to 8 mm. The third through holes are used to provide negative pressure, so as to quickly discharge excess moisture from the preliminarily adhered and formed fully granular cigarette/filter rod and reduce their temperature.

Preferably, the cooling/drying assembly is a modular assembly with the same structure and may be increased or decreased according to the requirements of dehumidification and drying, and generally 1 to 10 sets may be disposed.

In order to solve the above technical problems, the present invention further provides a method for preparing fully granular cigarette/filter rod by using the device for preparing fully granular cigarette/filter rod, including the following steps:

continuously and quantitatively introducing a granular material with an adhesive on the surface onto the mesh conveyor belt located on the first bottom plate by the feeding apparatus, and adsorbing the granular material to the mesh conveyor belt through the U-shaped groove of the first bottom plate and negative pressure provided by the first through holes of the first bottom plate;

conveying the granular material to the shrinking pre-forming cavity of the pre-forming apparatus along with the mesh conveyor belt under the action of negative pressure, shrinking the granular material together with the mesh conveyor belt in the pre-forming cavity until the cross-sectional area of the granular material is slightly larger than that of the forming cavity of the curing apparatus, to preliminarily form a fully granular cigarette/filter rod blank, the fully granular cigarette/filter rod blank and the mesh conveyor belt enters the forming cavity of the curing apparatus through the discharge port of the pre-forming apparatus, and heating and/or humidifying the fully granular cigarette/filter rod blank in the forming cavity to activate the adhesive on the surface of material granules, so that the granules in the material bond to each other to form a continuous solid porous material; introducing the formed continuous solid porous material into the cooling/drying cavity of the cooling/drying assembly through the mesh conveyor belt for cooling and drying, and applying negative pressure to the continuous solid porous material to obtain fully granular cigarette/filter rod with firm adhesion and appropriate moisture.

Preferably, the method for preparing fully granular cigarette/filter rod further includes wrapping with cigarette paper and/or forming paper, and cutting radially to obtain fully granular cigarette/filter rod products.

Preferably, the surface of the granules of the material is provided with a plurality of adhesive dots.

Preferably, the granules of the material have a diameter of 10 to 60 meshes, preferably 14 to 40 meshes.

Preferably, the granules of the material are heated at a temperature of 60-120° C. in the curing apparatus, and the amount of added liquid for increasing humidity is 10-25% of the mass of the granules.

Preferably, the fully granular cigarette/filter rod have a moisture content of 8-12% and a density of 0.4-1.0 g/ml, preferably 0.5-0.8 g/ml.

In order to solve the above technical problems, the present invention further provides fully granular cigarette/filter rod prepared by the preparation method.

Compared with the prior art, the advantages of the present invention are:

1. Neither the existing cigarette making device nor the filter rod forming machine can realize continuous forming of granular materials, and the device provided by the present invention realizes continuous forming of fully granular cigarette/filter rod for the first time;

2. The fully granular cigarette/filter rod of the present invention is of a new form, and can be endowed with more functions and connotations to provide consumers with better experience.

BRIEF DESCRIPTION OF THE DRAWINGS

In order to describe the technical solutions in the embodiments of the present invention or in the prior art more clearly, the following briefly introduces the accompanying drawings required in the description of the embodiments or the prior art. Apparently, the accompanying drawings in the following description show some embodiments of the present invention, and a person of ordinary skill in the art may still derive other drawings from these accompanying drawings without any creative effort.

In the figures: 1—guide wheel; 2—bracket; 3—feeding apparatus; 4—pre-forming apparatus; 5—first pressing plate; 6—first bottom plate; 7—fully granular cigarette/filter rod not wrapped in paper; 8—driving wheel;

9—curing apparatus; 91—forming cavity; 92—second through hole; 93—first air cavity; 94—second pressing plate; 95—second bottom plate; 96—heating assembly; 10—cooling/drying assembly; 101—cooling/drying cavity; 102—third through hole; 103—third pressing plate; 104—third bottom plate; 105—second air cavity; 11—mesh conveyor belt; 12—cutting and sorting apparatus; 13—paper wrapping apparatus;

15—filter rod forming machine; 151—forming paper; 152—garniture of a forming machine; 153—paper-wrapped fully granular cigarette/filter rod;

16—cigarette making machine; 161—cigarette paper; 162—garniture of a cigarette making machine; 163—filter rod; 164—tipping paper.

DETAILED DESCRIPTION OF EMBODIMENTS

The present invention will be further described below with reference to specific preferred embodiments, but the scope of protection of the present invention is not limited thereby.

For ease of description, the relative positional relationships of components, such as the descriptions of top, bottom, left, right, etc., are described according to the layout direction of the accompanying drawings in the specification, and do not limit the structure of this patent application.

Embodiment 1

Figure 1:
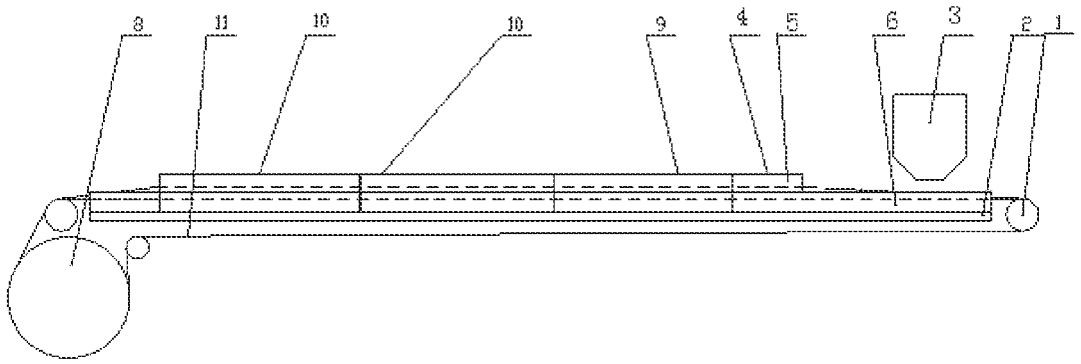
FIG. 1 is a schematic diagram of an overall elevation structure according to the first embodiment of the present invention.

As shown in FIG. 1, the first embodiment of a device for preparing fully granular cigarette/filter rod according to the present invention includes a mesh conveyor belt 11 mounted on a bracket 2. A feeding apparatus 3, a pre-forming apparatus 4, a curing apparatus 9, a cooling/drying assembly 10 (the cooling/drying assembly is a modular assembly, 1 to 10 sets of the cooling/drying assembly may be disposed according to requirements, and two sets are disposed in this embodiment), and a driving wheel 8 are sequentially mounted above the mesh conveyor belt 11.

The mesh conveyor belt 11 includes an upper conveyor belt and a lower conveyor belt connected into a whole, and two ends of the mesh conveyor belt are horizontally supported on a guide wheel 1 and a driving wheel 12. The upper conveyor belt passes a feeding port of the feeding apparatus 3 and passes through the pre-forming apparatus 4, the curing apparatus 8, and the cooling/drying assembly 10 in sequence.

A bottom of the feeding apparatus 3 is provided with a feeding port. A material is conveyed onto the mesh conveyor belt 11 through the feeding port. The feeding apparatus 3 is a commercially available high-precision quantitative feeding apparatus, which may be a constant volume feeding apparatus, a constant mass feeding apparatus, a constant flow feeding apparatus, a screw feeding apparatus, a pipeline feeding apparatus, similar apparatuses, or a combination thereof. Preferably, the feeding apparatus 3 may perform quantitative and uniform feeding of liquid, and/or perform pre-heating treatment.

The pre-forming apparatus 4 includes a first pressing plate 5 and a first bottom plate 6 buckled with each other to form a whole, the first bottom plate 6 is longer than the first pressing plate 5, and the first bottom plate 6 extends to a position below the feeding port of the feeding apparatus 3. The first bottom plate 6 is provided with a plurality of first through holes connected with a negative pressure apparatus to provide negative pressure to adsorb the granular material onto the mesh conveyor belt 11. A bottom of the first pressing plate 5 is provided with a U-shaped groove, and a top of the first bottom plate 6 is provided with a U-shaped groove. After the first pressing plate 5 and the first bottom plate 6 are buckled with each other, the U-shaped groove of the first pressing plate 5 is oppositely combined with the U-shaped groove of the first bottom plate 6 to form a pre-forming cavity, and the pre-forming cavity has a diameter reducing along a traveling direction of the material. When the mesh conveyor belt 11 carries the granular material to pass through the pre-forming cavity, the mesh conveyor belt 11 gradually shrinks in size and wraps the granular material with the shrinking of the pre-forming cavity.

Figure 2:
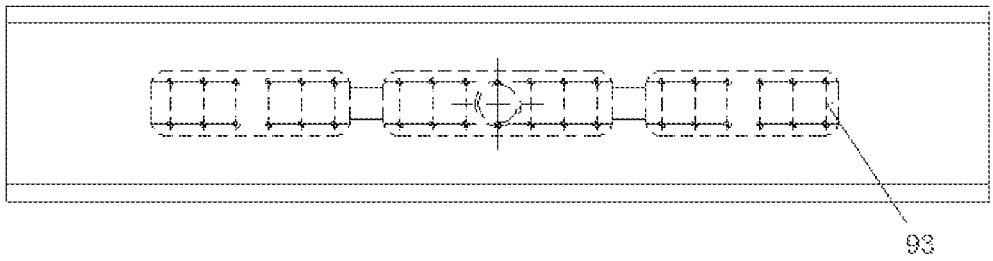
FIG. 2 is a top view structural diagram of a curing apparatus according to the present invention.
Figure 3:
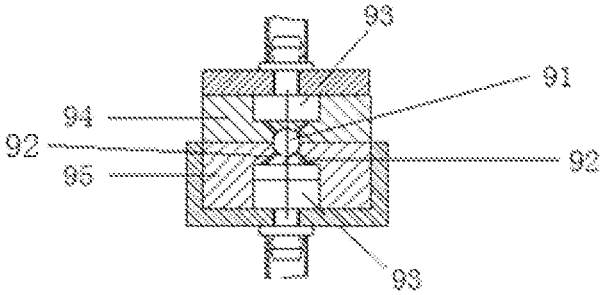
FIG. 3 is a cross-sectional structural diagram of the curing apparatus according to the present invention.

As shown in FIGS. 2 and 3, the curing apparatus 9 includes a second pressing plate 94 and a second bottom plate 95 joined together, and a forming cavity 91 is formed at the joint of the second pressing plate 94 and the second bottom plate 95. The cross-sectional shape of the forming cavity 91 is determined by the cross-sectional shape of fully granular cigarette/filter rod, and may be any of a circle, an ellipse, a diamond, a square, etc.; or it may also have any hollow pattern in the aforementioned shapes.

Both the second pressing plate 94 and the second bottom plate 95 are provided with a first air cavity 93 connected to external water vapor/humid hot air, and are provided with second through holes 92; and the first air cavity 93 is communicated with the forming cavity 91 via the second through holes 92. The second through holes 92 have a diameter of 0.3 to 0.8 mm and a distance between adjacent second through holes 92 is 5 to 10 mm. The second through holes 92 are used to provide water-containing hot air and/or saturated water vapor, so that granules have wet surfaces and are preliminarily adhered and formed.

Figure 4:
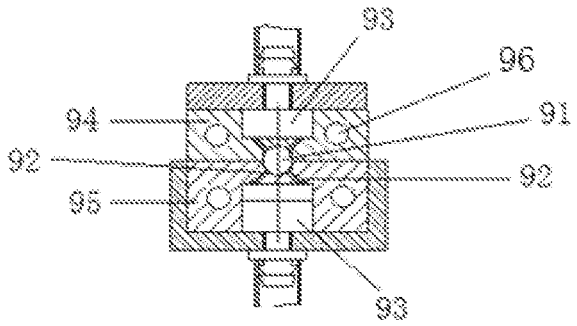
FIG. 4 is a cross-sectional structural diagram of the curing apparatus added with heating assemblies according to the present invention.

As shown in FIG. 4, heating assemblies 96 may be further disposed in the second pressing plate 94 and the second bottom plate 95 of the curing apparatus 9 in the present invention. The heating assemblies 96 are preferably power adjustable microwave generating apparatuses or electric heating tubes, for directly heating the granular material, or assisting in heating the water-containing hot air and/or saturated water vapor, and quickly realizing curing formation.

Figure 5:
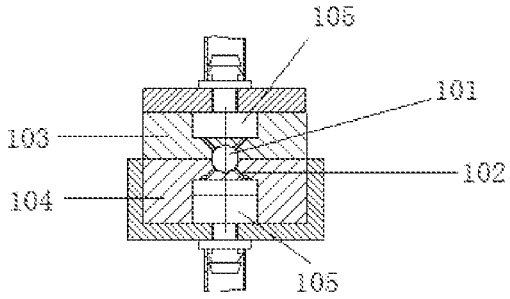
FIG. 5 is a cross-sectional structural diagram of a cooling/drying assembly according to the present invention.

As shown in FIG. 5, the cooling/drying assembly 10 roughly has the same structure as the curing apparatus 9, and also includes a third pressing plate 103 and a third bottom plate 104 joined together, and a cooling/drying cavity 101 is formed at the joint of the third pressing plate 103 and the third bottom plate 104. The third pressing plate 103 and the third bottom plate 104 are respectively provided with a second air cavity 105 connected to the negative pressure apparatus and a large number of third through holes 102 uniformly distributed, and the second air cavity 105 is communicated with the cooling/drying cavity 101 via the third through holes 102. The third through holes 102 have a diameter of 0.5 to 2 mm and a distance between adjacent third through holes 102 is 2 to 8 mm. The third through holes 102 are used to provide negative pressure, so as to quickly discharge excess moisture from the preliminarily adhered and formed fully granular cigarette/filter rod and reduce their temperature.

When the present invention is used, the mesh conveyor belt 11 is driven by the driving wheel 8 to move circularly around the guide wheel 1. The granular material uniformly falls on the mesh conveyor belt 11 located on the first bottom plate 3 through the feeding apparatus 3, the U-shaped groove of the first bottom plate 3 preliminarily gathers the granular material together, and the granular material is adsorbed onto the mesh conveyor belt 11 through negative pressure. The mesh conveyor belt 11 preliminarily wraps the granular material with gradual reduction of the U-shaped groove of the first bottom plate 6, then the granular material enters the pre-forming cavity, the mesh conveyor belt 11 further shrinks in the pre-forming cavity to wrap and form the granular material until the granular material has a cross-sectional area equal to that of the forming cavity 91, and the granular material enters the forming cavity 91 of the curing apparatus 9. The material is heated and humidified in the forming cavity 91 of the curing apparatus 9, so that adhesives on the surface of the granular material interact with each other for adhesion. Next, the material enters the cooling/drying assembly for cooling, drying, and dehumidification, and then the material is taken out by the mesh conveyor belt 11 to form a fully granular cigarette/filter rod 7 not wrapped in paper.

Embodiment 2

Figure 6:
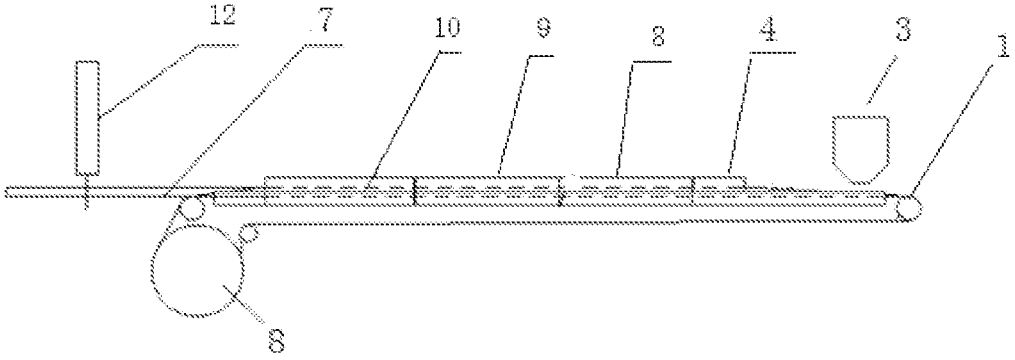
FIG. 6 is a schematic diagram of an overall structure according to the second embodiment of the present invention.

As shown in FIG. 6, the second embodiment of a device for preparing fully granular cigarette/filter rod according to the present invention is roughly the same as the first embodiment, except that a cutting and sorting apparatus 12 is disposed at an output end of the cooling/drying assembly. The cutting and sorting apparatus 12 cuts, sorts, and packs the formed fully granular cigarette/filter rod 7 not wrapped in paper. The cutting and sorting apparatus 12 may be a general cutting unit of an existing cigarette making machine and/or a filter rod forming machine, and the general cutting unit may also be reformed according to actual requirements.

Embodiment 3

Figure 7:
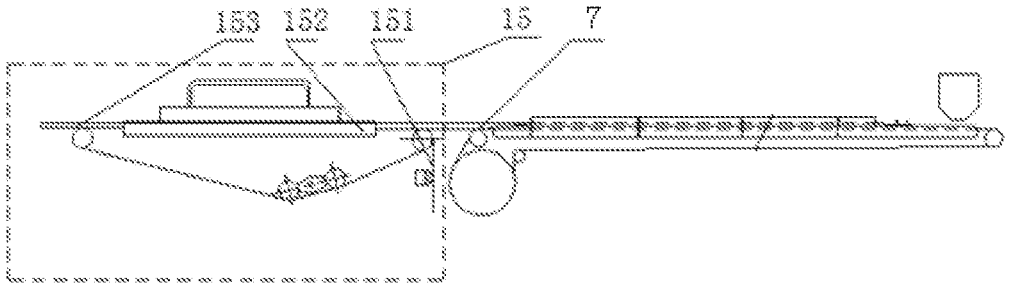
FIG. 7 is a schematic diagram of an overall structure according to the third embodiment of the present invention.

As shown in FIG. 7, the third embodiment of a device for preparing fully granular cigarette/filter rod according to the present invention is roughly the same as the first embodiment, except that the output end of the cooling/drying assembly 10 is connected to a paper wrapping apparatus 13 and a cutting and sorting apparatus 12 in sequence. In this embodiment, the paper wrapping apparatus 13 is preferably an existing filter rod forming machine 15. The formed fully granular cigarette/filter rod 7 not wrapped in paper and forming paper 151 are fed into a garniture 152 of the forming machine by a certain way for forming, and then cut and sorted into boxes by the cutting and sorting apparatus 13 to form paper-wrapped fully granular cigarette/filter rod 153.

Embodiment 4

Figure 8:
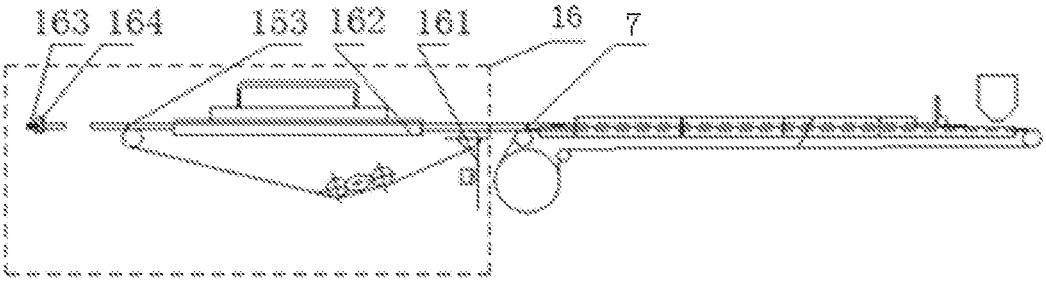
FIG. 8 is a schematic diagram of an overall structure according to the fourth embodiment of the present invention.

As shown in FIG. 8, the fourth embodiment of a device for preparing a fully granular cigarette/filter rod according to the present invention is roughly the same as the first embodiment, except that the output end of the cooling/drying assembly 10 is connected to an existing cigarette making machine 16 for integration and docking. The formed fully granular cigarette/filter rod 7 not wrapped in paper and cigarette paper 161 are fed into a cigarette gun 162 of the cigarette making machine by a certain way for forming, then the cut material segments are docked with filter rod 163, and the both are connected by tipping paper 164 to form paper-wrapped fully granular cigarette products.

The forgoing descriptions are only preferred embodiments of the present application, and do not limit the present application in any form. Although the present application is disclosed above with the preferred embodiments, the present application is not limited thereto. Some variations or modifications made by any skilled person familiar with the art using the disclosed technical contents without departing from the scope of the technical solution of the present application are equivalent to the embodiments, and all fall within the scope of the technical solution.

The invention claimed is:

1. A device for preparing a fully granular cigarette and filter rod, comprising a mesh conveyor belt-mounted on a bracket, characterized in that a feeding apparatus, a pre-forming apparatus with a pre-forming cavity, a curing apparatus with a forming cavity, and a cooling and drying assembly with a cooling and drying cavity are sequentially disposed on the bracket in a conveying direction of the mesh conveyor belt;

the mesh conveyor belt comprises an upper conveyor belt and a lower conveyor belt connected into a whole, and the upper conveyor belt passes a feeding port of the feeding apparatus and passes through the pre-forming cavity of the pre-forming apparatus, the forming cavity of the curing apparatus, and the cooling and drying cavity of the cooling and drying assembly;

a side wall of the pre-forming cavity is provided with a plurality of first through holes for providing negative pressure;

a side wall of the forming cavity of the curing apparatus is provided with a plurality of second through holes for providing water-containing hot air and/or saturated water vapor;

a side wall of the cooling and drying cavity of the cooling and drying assembly is provided with a plurality of third through holes for providing negative pressure and discharging excess moisture;

central positions of the pre-forming cavity, the forming cavity, and the cooling and drying cavity are kept on the same horizontal straight line; the pre-forming cavity, the forming cavity, and the cooling and drying cavity have the same cross-sectional shape, the cross-sectional area of a discharge port of the pre-forming cavity is larger than that of the forming cavity, and the cross-sectional area of the forming cavity is larger than that of the cooling and drying cavity.

2. The device for preparing the fully granular cigarette and filter rod according to claim 1, wherein the pre-forming apparatus comprises a first pressing plate and a first bottom plate buckled with each other, the pre-forming cavity is formed at the position where the first pressing plate and the first bottom plate are buckled with each other, and the cross-sectional area of the pre-forming cavity gradually reduces along a traveling direction of the material.

3. The device for preparing the fully granular cigarette and filter rod according to claim 1, wherein the curing apparatus comprises a second pressing plate and a second bottom plate joined together, opposite surfaces of the second pressing plate and the second bottom plate are respectively provided with a groove, and the grooves of the second pressing plate and the second bottom plate correspond exactly to form the forming cavity together; the cooling and drying assembly comprises a third pressing plate and a third bottom plate joined together, opposite surfaces of the third pressing plate and the third bottom plate are respectively provided with a groove, and the grooves of the third pressing plate and the third bottom plate correspond exactly to form the cooling and drying cavity together.

4. The device for preparing the fully granular cigarette and filter rod according to claim 3, wherein both the second pressing plate and the second bottom plate are provided with a first air cavity connected to external water vapor and/or humid hot air, and are provided with the second through holes; and the first air cavity is communicated with the forming cavity via the second through holes uniformly distributed.

5. The device for preparing the fully granular cigarette and filter rod according to claim 3, wherein both the third pressing plate and the third bottom plate are provided with a second air cavity connected to the negative pressure apparatus, and are provided with the third through holes; and the second air cavity is communicated with the cooling and drying cavity via the third through holes uniformly distributed.

6. The device for preparing the fully granular cigarette and filter rod according to claim 1, wherein the cross-sectional area of the cooling and drying cavity is 85-95% of that of the forming cavity.

7. The device for preparing the fully granular cigarette and filter rod according to claim 1, wherein the cooling and drying assembly is composed of 1 to 10 modular assemblies connected in series with the same structure.

* * * * *